United States Patent [19]

Schröder

[11] 4,015,840

[45] Apr. 5, 1977

[54] DEVICE FOR TESTING SHEETS DELIVERED FROM A FOLDING APPARATUS ASSOCIATED WITH ROTARY PRINTING PRESSES

[75] Inventor: Peter Schröder, Frankenthal, Germany

[73] Assignee: Albert-Frankenthal AG, Frankenthal, Germany

[22] Filed: Mar. 2, 1976

[21] Appl. No.: 663,016

[30] Foreign Application Priority Data

Mar. 27, 1975 Germany ..... 2513774

[52] U.S. Cl. ..... 271/64; 93/93 K

[51] Int. Cl.[2] ..... B65H 29/60

[58] Field of Search ..... 271/64; 198/436; 214/6 D; 93/93 K, 93 R

[56] References Cited

UNITED STATES PATENTS

| | | | |
|---|---|---|---|
| 3,684,279 | 8/1972 | Heimlicher | 271/64 |
| 3,754,647 | 8/1973 | DiFrank et al. | 271/64 |
| 3,904,019 | 9/1975 | Carlen et al. | 271/64 |
| 3,955,812 | 5/1976 | Suda et al. | 271/64 |

*Primary Examiner*—Robert W. Saifer
*Attorney, Agent, or Firm*—Allison C. Collard

[57] ABSTRACT

Positioned adjacent to the delivery end of a device for folding sheets delivered from a printing press is a sheet pick up device to intercept a sheet for test purposes. The mechanism to intercept the sheet includes a receiving roller carrying a guide belt which is moved into the delivery path and then transfers the sheet to a second guide belt for holding the test sheet between the two guide belts for delivery to a special delivery means where the sheet can be inspected. The roller is supported on a movable arm which is synchronized with the delivery belt of the folding apparatus, and the guide belts are arranged to move at a speed faster than the delivery belts. The removal of a sheet for test purposes does not interfere with the delivery of the other sheets and operations do not have to be stopped to test a sheet.

10 Claims, 7 Drawing Figures

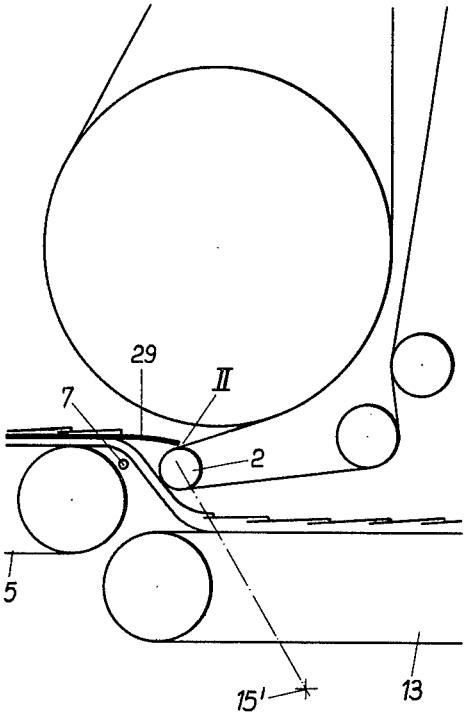
Fig. 4
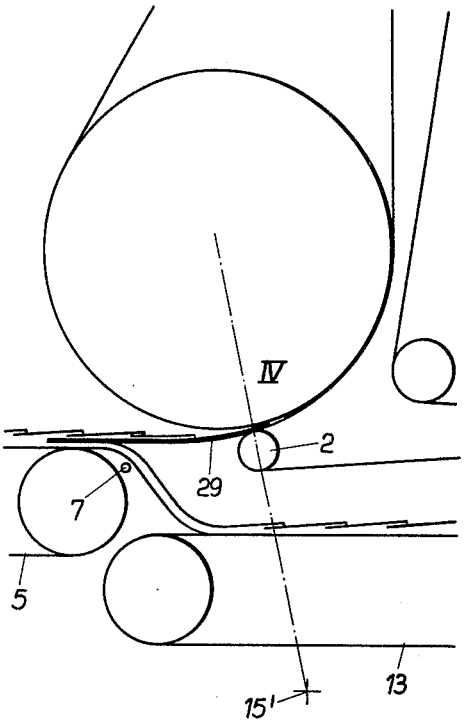
Fig. 5
Fig. 6
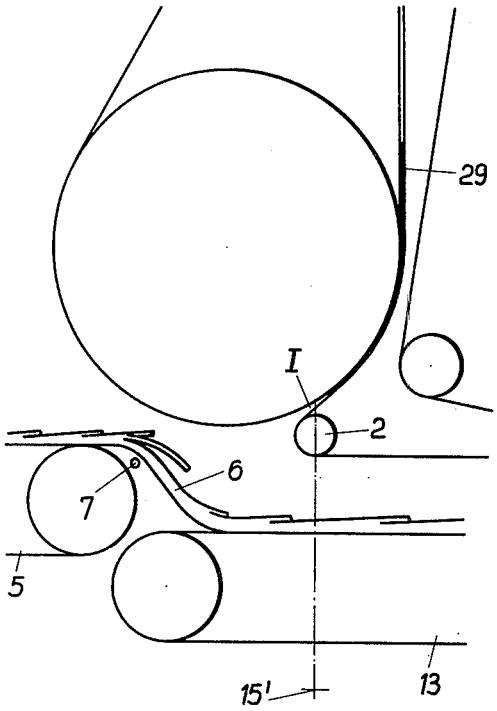

DEVICE FOR TESTING SHEETS DELIVERED FROM A FOLDING APPARATUS ASSOCIATED WITH ROTARY PRINTING PRESSES

This invention relates to a device for testing sheets which are delivered from a folding apparatus associated with rotary printing presses.

More specifically, the invention is concerned with a device at the delivery means of the folding apparatus in roller rotary printing presses.

An object of the invention is to provide for the removal of test sheets from a sheet-by-sheet flow of folded and overlapping printed material without disturbing the normal sheet-by-sheet flow which would be disadvantageous to the subsequent packaging or stacking of the sheets.

In accordance with the invention, a device is provided wherein subsequent to the delivery belt of the delivery means, a further delivery belt is provided and positioned at a lower level than the first-mentioned delivery belt. A receiving roller or roller rod is provided which is mounted on an oscillating arm and oscillates in a path between the end of the higher positioned receiving belt and delivery belts which run to a special delivery means. These delivery belts run faster than the first-mentioned delivery belt and the path of the roller rod moves in a path tangent to a drum around which one of the pair of delivery belts is running.

In the inventive device, the flow of sheets of the delivered printed products spreads into a cascade during the transfer from one delivery belt to the other. The receiving roller is lowered into this cascade for removing a test sheet, so that the test sheet runs between the receiving roller and the drum. During the return movement of the receiving roller, a forceful pressure is exerted onto the test sheet which accelerates the sheet and removes the test sheet from the flow of sheets. Even at a very substantial overlapping of the sheets a test sheet may be removed.

In another embodiment of the invention, the receiving roller is yieldably mounted on its oscillating arm by means of a spring. With this embodiment, in addition to being able to handle printed samples of different material thickness which can be gripped and engaged together with the fast running drum, the tangential range can be expanded.

The receiving roller may be freely rotatable. Preferably, the receiving roller is engaged by a guide belt which runs over an oscillating guide roller subjected to a spring tension and which moves past a stationary guide roller during the oscillating movement, so that the tension of the guide belt is maintained constant during the oscillating movement. The drive is carried out by a crank drive and an associated rolling key clutch. The crank drive provides for sinusoidal movement of the roller rod with favorable acceleration and delay, so as to be synchronized to the movement of the test sheet. The rolling key clutch permits a simple mechanical control, such as a single reduction coupling. Moreover, instead of this coupling means, a pneumatic or hydraulically operated piston-cylinder means may be employed.

A further advantage of the device of the invention is that it may also be used to receive waste paper from the flow of sheets. In this form of operation, the receiving roller remains stationary at the uppermost position of the higher positioned delivery belt, i.e., the oscillating movement of the receiving roller is interrupted at this return point. This can be realized with simple control means for the rolling key clutch.

Other objects and features of the present invention will become apparent from the following detailed description considered in connection with the accompanying drawings which disclose the embodiments of the invention. It is to be understood, however, that the drawings are designed for the purpose of illustration only and not as a definition of the limits of the invention.

In the drawings, wherein similar reference characters denote similar elements throughout the several views:

FIG. 4 shows a detail of the device for receiving a sheet by the receiving roller;

FIG. 5 shows a detail of the device for the acceleration of the sheets;

FIG. 6 shows a detail of the device for the further transport of the test sheet.

Figure 1:
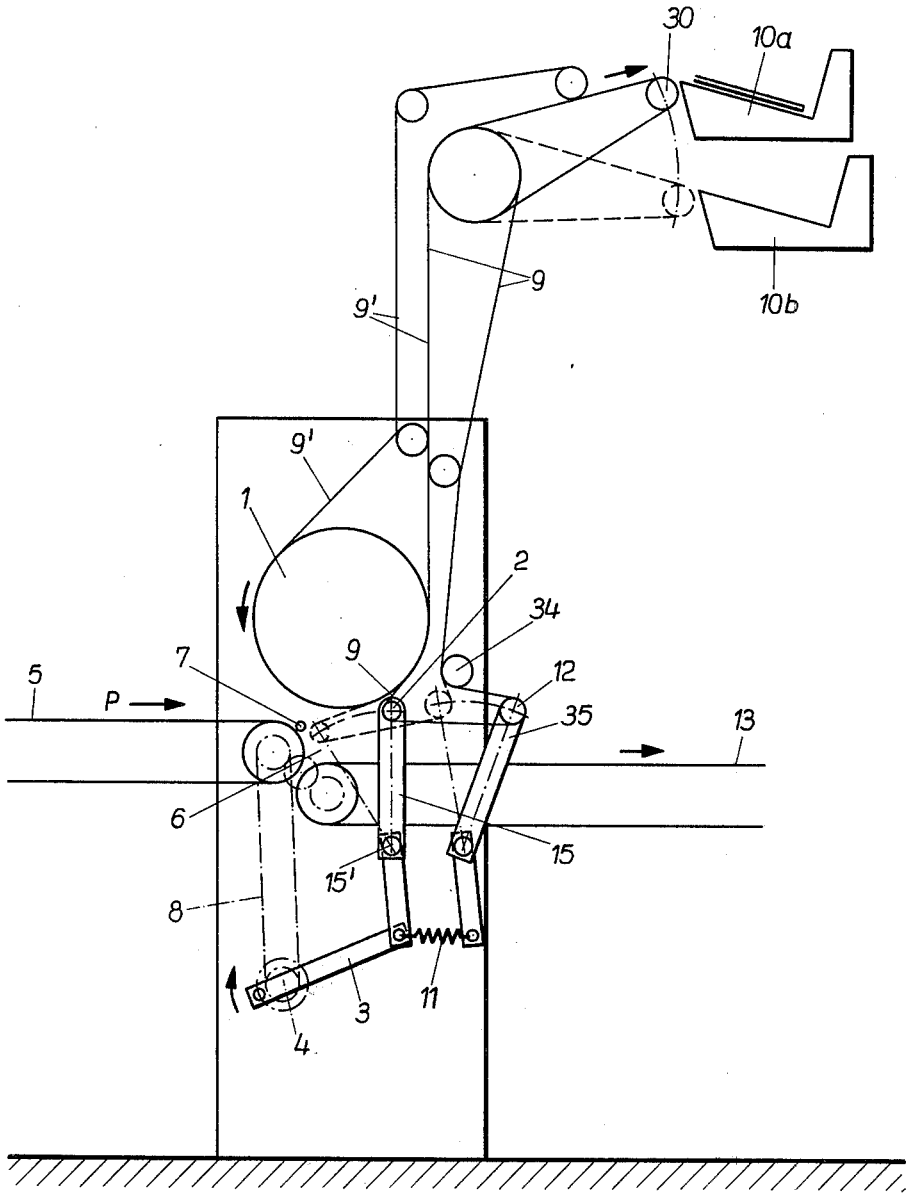
FIG. 1 shows a schematic side view of the device.

Referring now more particularly to FIGS. 1 to 6, of the accompanying drawings, a first delivery belt 5 positioned at a first level feeds sheets of printed material in a direction indicated by arrow P from the delivery means of a conventional folding apparatus of a roller rotary printing press (not shown). A second delivery belt 13 positioned at a second level lower than the first level is provided which moves in the direction indicated by the arrow and in the same direction as shown by arrow P. Belts 5 and 13 are juxtaposed to each other and move at the same rate of speed, with belt 13 being subsequent to or following belt 5. As can be seen in FIG. 6, the path of flow of sheets spreads into a cascade 6 as the sheets transfer from the first delivery belt to the second one. A receiving roller 2 is movable into the path of flow of cascade 6 to a test sheet. Receiving roller 2 may also include a roller rod which is engaged by a guide belt 9. Another guide belt 9′ runs about drum 1. Roller 2 and drum 1 are separately driven. Receiving roller 2 is mounted on the end of an oscillating arm 15 which is pivoted around a pivot defining pivot axis 15′ by means of a crank rod 3.

Figure 2:
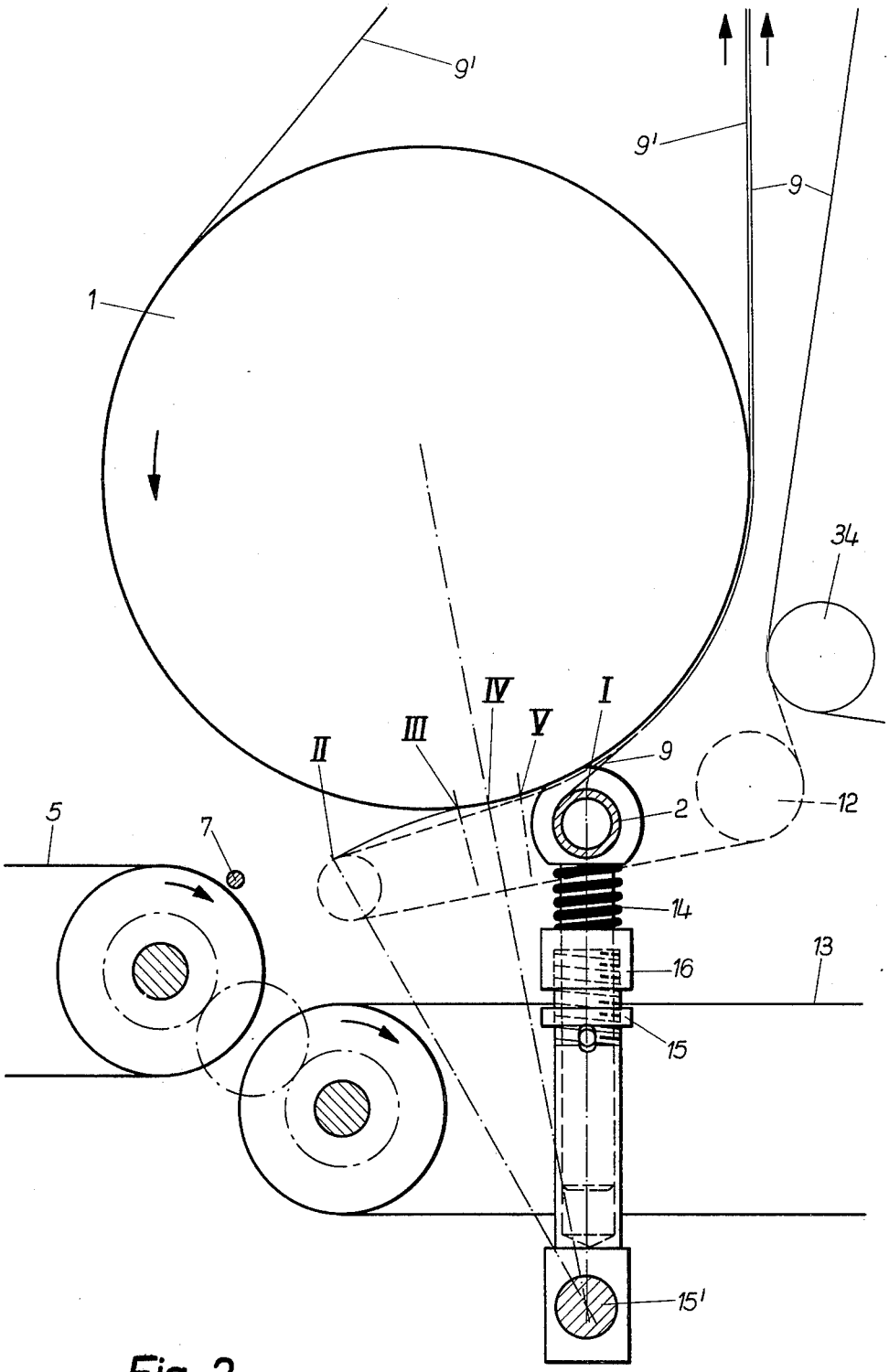
FIG. 2 shows an enlarged detail segment of the device of FIG. 1.

The pivot range of receiving roller 2 extends from a rest position I (FIG. 2) to a position II at which point (see FIG. 4) it moves under the back of a sheet, so that a test sheet 29 is moved onto receiving roller 2. Immediately after roller 2 is returned to position I, sheet 29 moves between guide belt 9 and guide belt 9′. Drum 1 is provided with a separate drive which either runs continuously or only when receiving a sheet of waste paper. The feeding speed of guide belt 9′ is appreciably higher than the feeding speed of delivery belt 5. The receiving roller 2 oscillates in a path around a center of rotation defined by the pivot axis 15′, so that the path of roller 2 makes tangential contact with drum 1. The path of movement of roller 2 is to the left from I to II, which is the sheet pick-up point and then to the right, as best seen in FIG. 2 of the drawing, to return roller 2 through the range of III to IV and V; this movement is made possible because receiving roller 2 is yieldably supported by means of spring 14 on its oscillating arm 15. Spring 14 is supported and operates against the force of a pretensioning adjusting nut 16. Rotating roller 2 exerts a forceful pressure onto the front edge of sheet 29 during its return movement thus removing the sheet 29 from the sheet-by-sheet or cascade flow 6.

FIG. 5 shows such an intermediary position at IV during acceleration of the sheet. While the receiving roller 2 moves in the same direction as the sheet-by-sheet flow, the higher speed of drum 1 and belt 9' thereon with respect to delivery belt 5 insures that a subsequent sheet is not fed into guide belts 9, 9', but drops onto the subsequent transport belt 13, so that the sheet-by-sheet flow is not affected by the removal of a test sheet 29. The use of the spring 14 to support receiving roller 2 on oscillating arm 15 permits removal of printed material having a different thickness, so that with an increasing thickness of the product the pressure range between III and V increases and thereby the pressure force itself.

The pair of guide belts 9, 9' delivers test sheet 29 which has been removed from the sheet-by-sheet flow onto a special delivery means 10*b* (FIG. 1).

As is shown in FIG. 1, guide belt 9 is guided over a guide roller 12 which is under spring tension 11 and oscillates on an oscillating arm 35 and moves past a stationary guide roller 34 during its oscillating movement, so that the guide belt 9 is in a tight or taut condition during the oscillating movement.

Drum 1 and guide belt 9 are driven by means of a separate motor and are independent from the machine speed. In contrast thereto, oscillating arm 15 is driven synchronously with the machine from the folding apparatus by means of a gear belt 8, a rolling key clutch 4 and a crank drive 3. As can be seen from FIG. 3, part 18 of the rolling key clutch is the constantly driving part and rotates in the direction of arrow D. This part contains at its circumference only one groove 31 into which rolling key clutch 17 can engage and it is located on the boss 19 which is keyed with roller 25 of crank drive 3, so that oscillating arm 15 may be so adjusted that receiving roller 2 engages the sheet-by-sheet flow shortly before an oncoming back side of a sheet.

Figure 3:
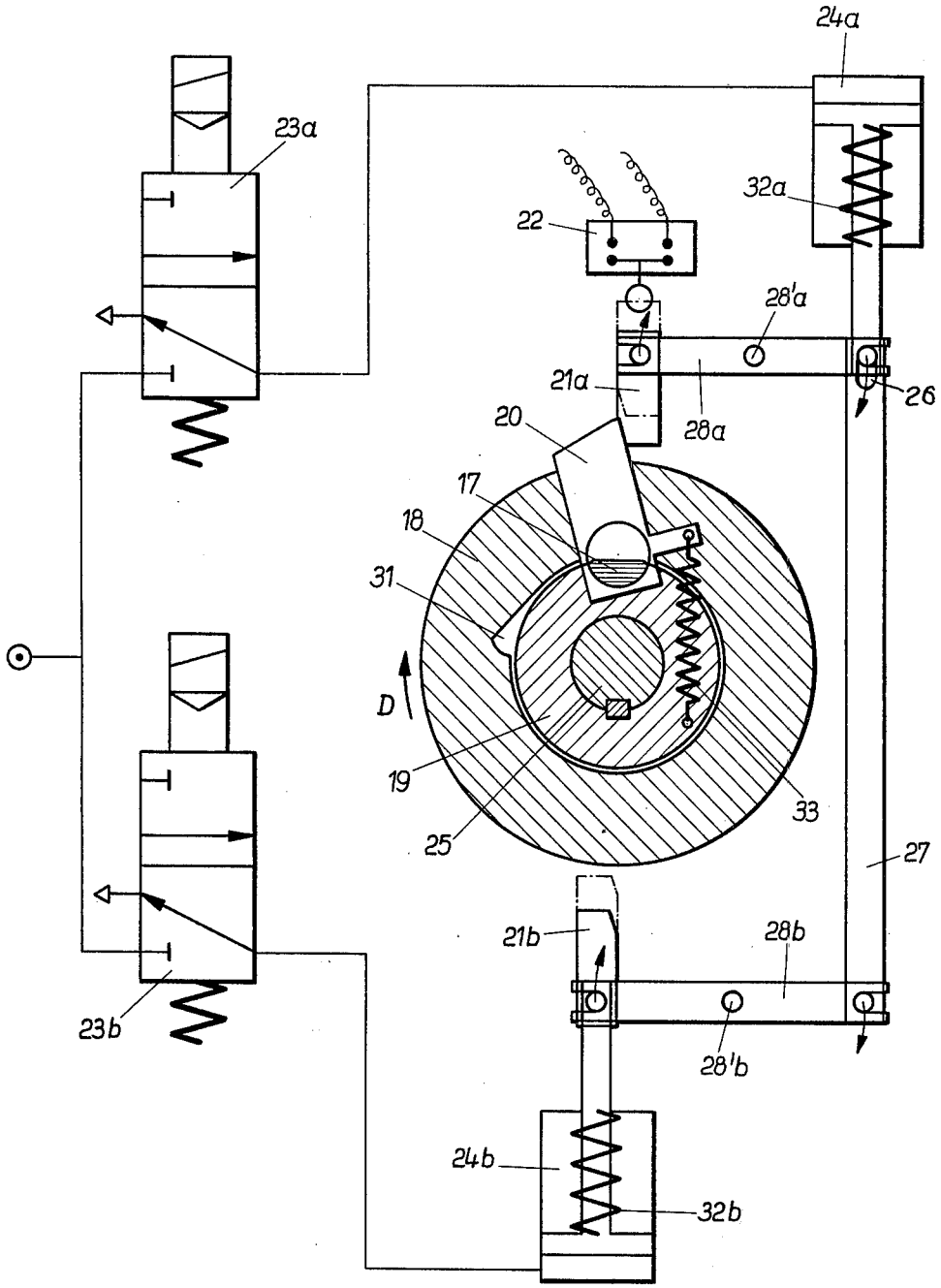
FIG. 3 shows the control for the rolling key clutch.

The control of rolling key clutch 4 to remove a test sheet is carried out in accordance with the schematic arrangement of FIG. 3. Magnet valve 23*a* is actuated by pressing a button, so that compressed air is admitted into a cylinder 24*a*. Cylinder 24*a* includes a piston rod which moves against the force of a return spring 32*a* and a two-armed pivotable lever 28*a* to move an abutment 21*a*, shown in full lines in FIG. 3, which extends into the rotary path of an arm 20 rigidly mounted on key clutch 17. The two armed pivotably mounted lever 28*a* rotates around rotating point 28*a*'. Upon movement of abutment 21*a*, arm 20 is rotated in clockwise direction, i.e., as far as the air between the driving point 18 and boss 19 permits the rotation under the force of a tension spring 33 which engages arm 20 and is coupled to boss 19. This minute rotation of arm 20, moves the arm beneath abutment 21*a* which moves back into its resting position as shown in full lines in FIG. 3. When the abutment arm 21*a* is moved to its dotted outline position, the back of the arm actuates an end switch 22, which cause the compressed air in cylinder 24*a* to be discharged, so that return spring 32*a* in cylinder 24*a* causes the abutment 21*a* to be moved back into place as shown in full outline. Groove 31 in driven part 18 of the clutch engages key clutch 17 which pivots under the force of tension spring 33 across arm 20 and cams the arm and roller 25 which is keyed with boss 19. Crank drive 3 which includes roller 25 and boss 19 is moved until arm 20 engages abutment 21*a* which in the meantime is returned to its starting position, so that key clutch 17 is rotated out of engagement during the further movement of boss 19. The crank drive in this manner completes a full rotation and oscillating arm 15 a forward and return stroke. Rod 27 which is shown in FIG. 3 remains in a resting position during actuation of cylinder 24*a*, due to longitudinal aperture 26.

To remove waste paper, receiving roller 2 is moved from its resting position point I to point II and remains there. The sheets engage drum 1 and belt 9' and are channeled between guide belts 9 and 9' accelerated therein and fed to delivery means 10*b* by means of a diverter 30. When the waste paper end appears, receiving roller 2 is moved back into its resting position I and separates the sheet-by-sheet flow in that one sheet is pressed by the rotating receiving roller against drum 1 and is thereby forcefully accelerated. The falling sheet drops onto delivery belt 13 like in an individual receiving procedure.

The control procedure for removing waste paper is carried out by actuating a push button of a reversing switch, so that magnet valve 23*b* is reversed and cylinder 24 is admitted with air. An abutment 21*b*, which is diametrically positioned with respect to the previously described abutment 21*a* is engaged, and abutment 21*a* is disengaged by rod 27. As cylinder 24*a* is without air, the piston of cylinder 24*a* is moved forwardly after overcoming the force of return spring 32*a*.

Arm 20 is thereby released and the key clutch 17 engages the coupling shaft 25 which executes half a rotation until abutment 21*b* removes key clutch 17 from shoulder 31 by means of arm 20. At this point, receiving roller 2 is positioned at point II and remains there during removal of waste paper. To complete the cycle, the reversing switch is released and magnet valve 23*b* is switched back to its original condition. The air from cylinder 24*b* is released and abutment 21*b* is disengaged and abutment 21*a* engaged by means of return springs 32*a*, 32*b* in cylinders 24*a*, 24*b*, respectively. Coupling shaft 25 executes the second half of rotation and comes to rest at its stationary position. Receiving roller 2 now oscillates back to point I.

Figure 7:
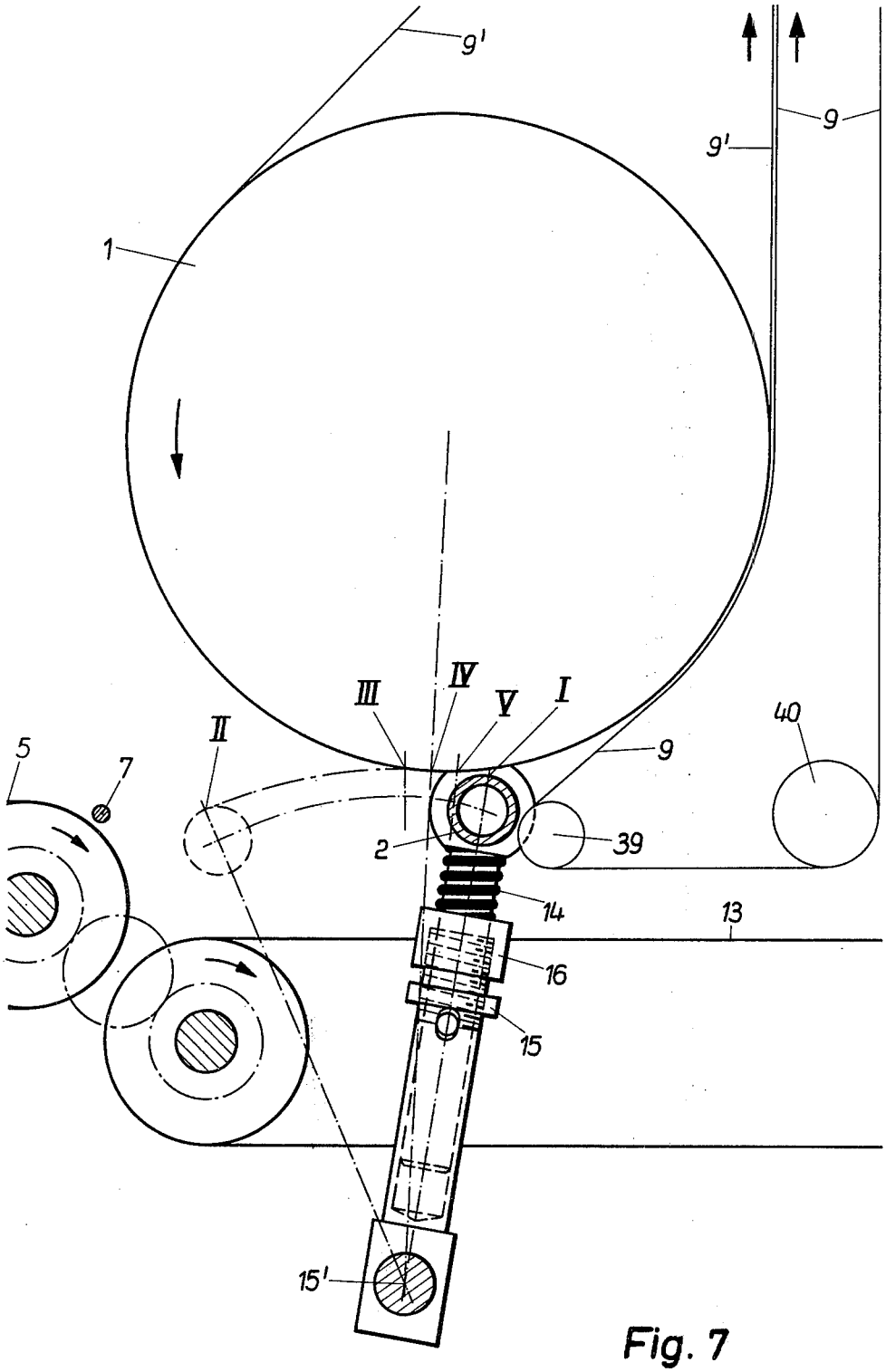
FIG. 7 shows a modification of the embodiment shown in FIG. 2.

The system shown in FIG. 7 is a modification of the embodiment shown in FIG. 2. Receiving roller 2 is not connected with guide belts 9, i.e., the receiving roller is freely movable without requiring a balancing of the guide belt. As described with respect to FIG. 2, the receiving roller moves into position II during its first stroke and engages the sheet-by-sheet flow, receiving one sheet on drum 1 during the return stroke thus pressing the sheet against the faster moving rotating drum, so that the sheet is accelerated and fed into the guide belt. Guide belt 9 is guided over separate rollers 39 and 40 so that belt 9 runs synchronously with guide belt 9' which runs around drum 1.

A stabilization rod 7 on cascade 6 prevents the sheet-by-sheet flow from prematurely dropping onto the delivery belt when the machine operates at a slow speed. When printing pressure, applied, the sheets slide over the stabilization rod without engaging it (see FIGS. 4–6). Relays 23*a* and 23*b* may be controlled from the command stations of the printing press. The electric control may also be operated automatically by the roller support with a delay when the waste paper is removed during a bonding process.

While only two embodiments of the present invention have been shown and described, it will be obvious to those skilled in the art that many changes and modifications may be made thereunto without departing from the spirit and scope of the invention.

What is claimed is:

1. Device for testing sheets which are delivered from a folding apparatus associated with rotary printing presses having a first delivery belt positioned at a first level movable at a predetermined rotary speed for delivering folded sheets of printed matter, comprising:

a second delivery belt positioned adjacent to and at a second level lower than said first level for normally receiving the printed sheets and movable at the same rate of speed as said first delivery belt;

a rotatable drum;

a first guide belt coupled with and movable with said rotatable drum and movable at a speed higher than said predetermined speed;

a receiving roller;

a second guide belt coupled with and movable at the same speed as said first guide belt and movable in tangential juxtaposition therewith adapted to transport a folded sheet therebetween;

an oscillatable arm connected with and supporting said receiving roller for oscillatory movement from a first position remote from said first delivery belt to a second position adjacent to said first delivery belt to intercept one of the sheets leaving said first delivery belt onto said second guide belt and movable to a third position to transfer said intercepted sheet to said tangential juxtaposition of said first and second guide belts, said receiving roller being moved into tangential contact with said rotatable drum when said oscillatable arm moves into the third position thereof; and a special delivery means positioned at a delivery end of said tangentially positioned guide belts for receiving the sheet carried between said guide belts.

2. The device as recited in claim 1, including a spring yieldably mounting said receiving roller to said oscillatable arm.

3. Device as recited in claim 1, including a second special delivery means, positioned adjacent to said first-mentioned delivery means, a deflector positioned at said delivery end end of said guide belts and movable between said first and second delivery means, and means to actuate said deflector to transfer said intercepted sheet to either of said delivery means.

4. Device as recited in claim 1, having a drive for said first delivery belt including a drive for said oscillatable arm comprising a crank drive and a rolling key clutch coupled thereto and with said first-mentioned drive for said first delivery belt for oscillating said oscillatable arm in synchronism with said first delivery belt.

5. Device as recited in claim 4, including an oscillatable guide roller, a second oscillatable arm connected with said guide roller for support thereof, a tension spring connecting said second oscillatable arm with said crank drive, a stationary guide roller, said second guide belt passing over said oscillatable and said stationary guide rollers, and said oscillatable guide roller being oscillatable with said second oscillatable arm and held in tension to said first oscillatable arm by means of said spring whereby to maintain said second guide belt in a taut condition on said receiving roller during movement thereof by said first oscillatable arm.

6. Device as recited in claim 5, including a control mechanism for said rolling key clutch comprising a key clutch, a crank shaft, a boss keyed to said crank shaft, a supporting arm rigidly mounted on said key clutch, a spring connected between said supporting arm and said boss for rotating said supporting arm, a stationary abutment engageable with said arm to hold it against rotation and movable out of engagement with said supporting arm for permitting rotation thereof under the tension force of said spring, a two-armed lever, said stationary abutment being connected with one of said arms, a piston-cylinder combination including a return spring and a piston rod connected with said other arm and movable against the force of said return spring, and a magnet valve coupled with said piston-cylinder combination to control the admission of compressed air into the cylinder to move said piston to move said abutment out of engagement with said supporting arm, and an end switch adapted to cause the compressed air to be discharged from the cylinder responsive to activation by said supporting arm upon said abutment moving out of engagement therewith.

7. Device as recited in claim 6, including a second magnetic valve, a second piston-cylinder combination coupled with said second magnetic valve upon activation thereof causing compressed air to be admitted into the cylinder, a further stationary abutment coupled to the piston, a second return spring coupled with said piston, a fulcrum having one end connected with said other arm, a second two armed lever, one of said arms being pivotally mounted on said second abutment and the other of said arms being coupled with the other arm of said fulcrum, said abutments being interconnected by said fulcrum whereby to cause disengagement between said first mentioned abutment and said supporting arm upon activation of said second-mentioned magnetic valve to admit compressed air into said second cylinder.

8. The device as recited in claim 7, including a remote control for each said magnetic valves, whereby to position said remote control at a control station for the printing press.

9. Device as recited in claim 7, wherein said oscillating arm and support for said receiving roller includes means coupled with said second magnetic valve for automatic control thereof with a delay for removing waste paper during a bonding process.

10. The device as recited in claim 1, including a stabilization rod proximate to said first delivery belt to prevent premature dropping of the sheets therefrom onto said second delivery belt.

* * * * *